US011808261B2

(12) United States Patent
Liu et al.

(10) Patent No.: US 11,808,261 B2
(45) Date of Patent: Nov. 7, 2023

(54) VARIABLE CAPACITY COMPRESSOR OPERATION MODE DETERMINATION METHOD AND DEVICE, VARIABLE CAPACITY COMPRESSOR, AND AIR CONDITIONER

(71) Applicant: GREE ELECTRIC APPLIANCES, INC. OF ZHUHAI, Zhuhai (CN)

(72) Inventors: Hua Liu, Zhuhai (CN); Longfei Li, Zhuhai (CN); Handong Xue, Zhuhai (CN); Yi Ni, Zhuhai (CN); Yingsheng Fu, Zhuhai (CN); Yaopeng Rong, Zhuhai (CN); Zhongqiu Zhang, Zhuhai (CN); Qunbo Liu, Zhuhai (CN); Ke Xu, Zhuhai (CN)

(73) Assignee: GREE ELECTRIC APPLIANCES, INC. OF ZHUHAI, Zhuhai (CN)

( * ) Notice: Subject to any disclaimer, the term of this patent is extended or adjusted under 35 U.S.C. 154(b) by 212 days.

(21) Appl. No.: 17/285,802

(22) PCT Filed: Dec. 14, 2018

(86) PCT No.: PCT/CN2018/121200
§ 371 (c)(1),
(2) Date: Apr. 15, 2021

(87) PCT Pub. No.: WO2020/077790
PCT Pub. Date: Apr. 23, 2020

(65) Prior Publication Data

US 2021/0340977 A1 Nov. 4, 2021

(30) Foreign Application Priority Data

Oct. 19, 2018 (CN) ..... 201811219713.1

(51) Int. Cl.
*F04B 51/00* (2006.01)
*F04B 25/00* (2006.01)
(Continued)

(52) U.S. Cl.
CPC ..... *F04B 51/00* (2013.01); *F04B 25/005* (2013.01); *F04B 49/065* (2013.01);
(Continued)

(58) Field of Classification Search
CPC ..... F04B 51/00; F04B 25/005; F04B 49/065; F04B 2203/0201; F04B 2203/0204;
(Continued)

(56) References Cited

U.S. PATENT DOCUMENTS 7,917,334 B2 * 3/2011 Saunders ..... F04B 51/00 702/182
2007/0154329 A1 * 7/2007 Onoda ..... F04C 23/001 417/216

FOREIGN PATENT DOCUMENTS

CN 102072529 A 5/2011
CN 103162384 A 6/2013
(Continued)

OTHER PUBLICATIONS

International Search Report dated Jun. 13, 2019, issued in corresponding International Application No. PCT/CN2018/121200, filed Dec. 14, 2018, 3 pages.
(Continued)

*Primary Examiner* — Charles G Freay
(74) *Attorney, Agent, or Firm* — CHRISTENSEN O'CONNOR JOHNSON KINDNESS PLLC

(57) ABSTRACT

Disclosed are a variable capacity compressor operation mode determination method and device, a variable capacity compressor and an air conditioner. The variable capacity compressor operation mode determination method includes:
(Continued)

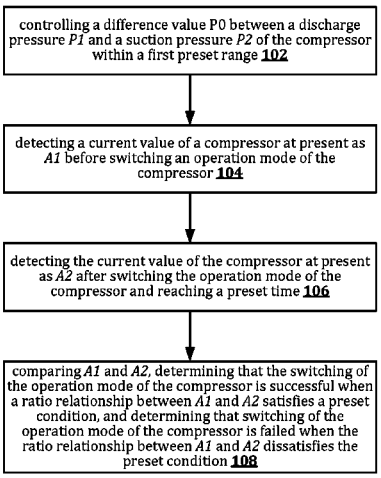

detecting a current value of a compressor at present as A1 before switching an operation mode of the compressor; detecting the current value of the compressor at present as A2 after switching the operation mode of the compressor and reaching a preset time; comparing A1 and A2, determining that the switching of the operation mode of the compressor is successful when a ratio relationship between A1 and A2 satisfies a preset condition, and determining that switching of the operation mode of the compressor is failed when the ratio relationship between A1 and A2 dissatisfies a preset condition.

15 Claims, 1 Drawing Sheet

(51) Int. Cl.

| | |
|---|---|
| ***F04B 49/06*** | (2006.01) |
| ***F04C 23/00*** | (2006.01) |
| ***F04C 28/06*** | (2006.01) |
| ***F04C 28/08*** | (2006.01) |
| ***F04C 28/28*** | (2006.01) |
| *F04B 41/00* | (2006.01) |
| *F04C 18/356* | (2006.01) |
| *F04C 18/344* | (2006.01) |
| *F04C 28/02* | (2006.01) |

(52) U.S. Cl.
CPC ..... *F04C 23/001* (2013.01); *F04C 28/065* (2013.01); *F04C 28/08* (2013.01); *F04C 28/28* (2013.01); *F04B 41/00* (2013.01); *F04B 2203/0201* (2013.01); *F04B 2203/0204* (2013.01); *F04C 18/344* (2013.01); *F04C 18/356* (2013.01); *F04C 28/02* (2013.01); *F04C 2270/075* (2013.01); *F04C 2270/095* (2013.01)

(58) Field of Classification Search
CPC ..... F04C 23/001; F04C 28/08; F04C 28/28; F04C 28/02; F04C 18/344; F04C 18/356; F04C 2270/075; F04C 2270/096
USPC ..... 417/216, 220
See application file for complete search history.

(56) References Cited

FOREIGN PATENT DOCUMENTS

| | | | |
|---|---|---|---|
| CN | 103363614 | A | 10/2013 |
| CN | 104047843 | A | 9/2014 |
| CN | 104421139 | A | 3/2015 |
| CN | 104654516 | A | 5/2015 |
| CN | 106500257 | A | 3/2017 |
| CN | 106765885 | A | 5/2017 |
| CN | 108468843 | A | 8/2018 |
| JP | 2006022723 | A | 1/2006 |
| JP | 2010163926 | A | 7/2010 |
| JP | 2016023885 | A | 2/2016 |
| KR | 100585809 | B1 | 6/2006 |
| WO | 2014/189093 | A1 | 11/2014 |
| WO | 2018/026791 | A1 | 2/2018 |

OTHER PUBLICATIONS

Office Action dated Sep. 16, 2021, in corresponding Indian application No. 202147021600, 6 pages.
Extended European Search Report dated Oct. 15, 2021, issued in corresponding European Application No. EP18937304, 29 pages.
Office Action dated Apr. 26, 2022, in corresponding Japanese Application No. 2021519589, 10 pages.

* cited by examiner

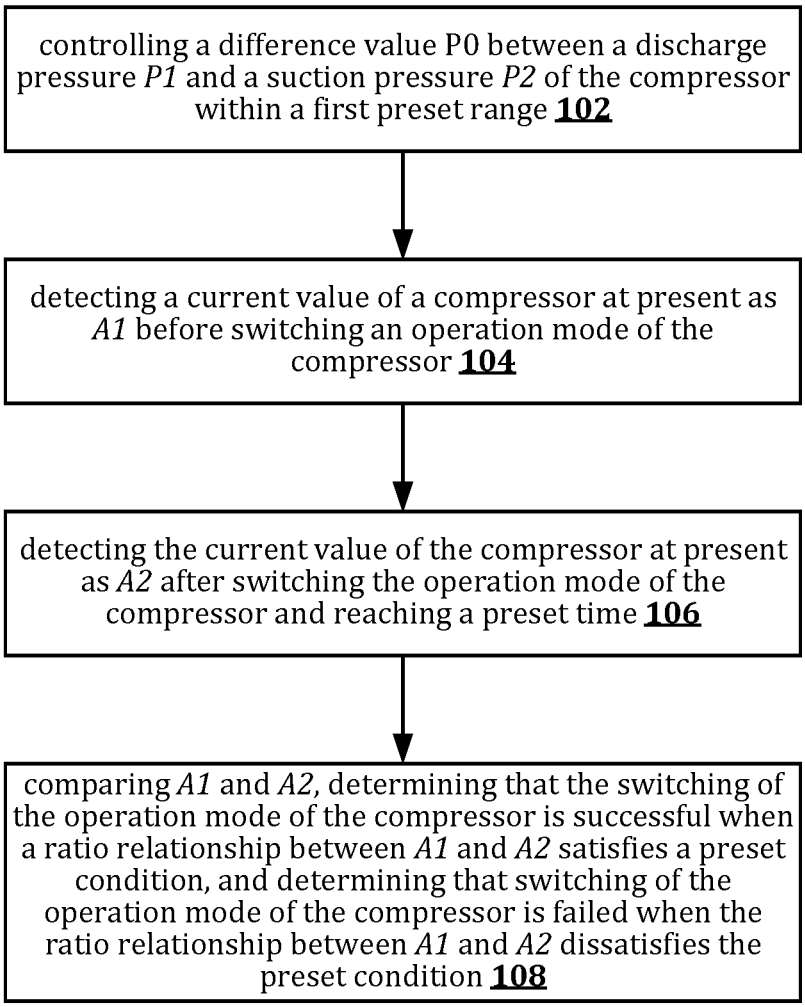
controlling a difference value P0 between a discharge pressure *P1* and a suction pressure *P2* of the compressor within a first preset range 102
detecting a current value of a compressor at present as *A1* before switching an operation mode of the compressor 104
detecting the current value of the compressor at present as *A2* after switching the operation mode of the compressor and reaching a preset time 106
comparing *A1* and *A2*, determining that the switching of the operation mode of the compressor is successful when a ratio relationship between *A1* and *A2* satisfies a preset condition, and determining that switching of the operation mode of the compressor is failed when the ratio relationship between *A1* and *A2* dissatisfies the preset condition 108

VARIABLE CAPACITY COMPRESSOR OPERATION MODE DETERMINATION METHOD AND DEVICE, VARIABLE CAPACITY COMPRESSOR, AND AIR CONDITIONER

CROSS REFERENCE TO RELATED APPLICATION

The present application claims priority to Chinese Patent Application with No. 201811219713.1, filed on Oct. 19, 2018, the content of which is expressly incorporated herein by reference in its entirety.

TECHNICAL FIELD

The present disclosure relates to the field of compressor, and particularly to a variable capacity compressor operation mode determination method and device, a variable capacity compressor and an air conditioner.

BACKGROUND

The variable capacity compressor includes more than two cylinders, and the application thereof has the following problems.

In the single-cylinder operation, the compressor has only one rotor for compression. The rotation of the rotor belongs to an eccentric rotation. During the compression, the force on the rotor changes all the time as the pressure in the compression chamber changes. At the moment, if the force on the rotor needs to be stabilized, the current needs to be adjusted according to the pressure of the compression chamber to balance the force on the rotor.

When the two cylinders operate, if the two rotors are arranged symmetrically, and the two cylinders are of equal volume, and the two rotors operate symmetrically, the force is symmetrical, and the stable operation with low jitter can be achieved without changing the magnitude of the current.

In the dual-cylinder operation, if the volumes of the two cylinders are different, the compressor can also have the problem of large jitter.

Therefore, for large and small cylinder compressors, under the single-cylinder operation and the double-cylinder operation, the compressor displacement and motor efficiency are different, and the lubrication system control is also different. It is necessary to perform respective operation for the characteristics of single-cylinder operation and double-cylinder operation to achieve the optimal use mode of the compressor.

As for the above problems of large and small cylinder compressors, it is necessary to accurately determine whether the switching between single-cylinder and double-cylinder of the compressor is successful in order to perform the system control.

SUMMARY

One purpose of the present disclosure is to provide a variable capacity compressor operation mode determination method and device, a variable capacity compressor and an air conditioner, to improve the accuracy of determination of whether the switching of the operation mode of the compressor is successful.

In one aspect of some embodiments of the present disclosure, a variable capacity compressor operation mode determination method is provided, which includes:

detecting a current value of a compressor at present as A1 before switching an operation mode of the compressor; detecting the current value of the compressor at present as A2 after switching the operation mode of the compressor and reaching a preset time; comparing A1 and A2, determining that the switching of the operation mode of the compressor is successful when a ratio relationship between A1 and A2 satisfies a preset condition, and determining that the switching of the operation mode of the compressor is failed when the ratio relationship between A1 and A2 dissatisfies the preset condition.

In some embodiments, the method further includes: before switching the operation mode of the compressor, controlling a difference value P0 between a discharge pressure P1 and a suction pressure P2 of the compressor within a first preset range and then detecting the current value of the compressor.

In some embodiments, the method further includes: if the difference value P0 between the discharge pressure P1 and the suction pressure P2 of the compressor is less than a set lower limit value of the first preset range, increasing the difference value P0 between the discharge pressure P1 and the suction pressure P2 by increasing an operation frequency of the compressor.

In some embodiments, the method further includes: if the difference value P0 between the discharge pressure P1 and the suction pressure P2 of the compressor is greater than a set upper limit value of the first preset range, reducing the difference value P0 between the discharge pressure P1 and the suction pressure P2 of the compressor by reducing the operation frequency of the compressor and/or by pressure relief which is performed by switching on a compressor suction-discharge side bypass mechanism.

In some embodiments, the method further includes: before switching the operation mode of the compressor, controlling the operation frequency of the compressor within a second preset range and then detecting the current value of the compressor at present.

In some embodiments, the method further includes: increasing the operation frequency of the compressor if the operation frequency of the compressor is less than the set lower limit value of the second preset range, and reducing the operation frequency of the compressor if the operation frequency of the compressor is greater than the set upper limit value of the second preset range.

In some embodiments, the compressor includes at least two cylinders, at least one cylinder is in a working state; the switching of the operation mode of the compressor includes a first switching mode and a second switching mode; in the first switching mode, the compressor is switched to an operation mode in which a number of the cylinders in the working state is increased; in the second switching mode, the compressor is switched to an operation mode in which a number of the cylinders in the working state is reduced.

In some embodiments, the method further includes: comparing A1 with A2, and determining that the switching of the operation mode of the compressor is successful when the compressor is switched to an operation mode in which a number of cylinders in a working state is increased and the relationship between A1 and A2 satisfies the preset condition $A2 \geq m*A1$ where $m \geq 1$.

In some embodiments, the method further includes: comparing A1 with A2, and determining that the switching of the operation mode of the compressor is successful when the compressor is switched to an operation mode in which a number of cylinders in a working state is reduced and the ratio relationship between A1 and A2 satisfies the preset condition A2 where m≥1.

In some embodiments, a value range of m is [1.2, 2].

In some embodiments of the present disclosure, a variable capacity compressor operation mode determination device is provided, which is configured to implement the above-mentioned variable capacity compressor operation mode determination method, and includes: a detection unit, configured to detect a current value of the compressor at present as A1 before switching an operation mode of the compressor, and detect the current value of the compressor at present as A2 after switching the operation mode of the compressor and reaching a preset time; and a comparison determination unit, configured to compare A1 with A2, determine that the switching of the operation mode of the compressor is successful when the ratio relationship between A1 and A2 satisfies a preset condition, and determine that the switching of the operation mode of the compressor is failed when the ratio relationship between A1 and A2 dissatisfies the preset condition.

In some embodiments of the present disclosure, a computer device is provided, which includes a memory and a processor; a computer program is stored on the memory and executable on the processor, the processor executes the computer program to implement the above-mentioned variable capacity compressor operation mode determination method.

In some embodiments of the present disclosure, a storage device including computer-executable instructions is provided, the storage device including the computer-executable instructions is configured to, when executed by a computer processor, perform the above-mentioned variable capacity compressor operation mode determination method.

In some embodiments of the present disclosure, a variable capacity compressor is provided, which includes any one of the above-mentioned devices.

In some embodiments of the present disclosure, an air conditioner is provided, which includes any one of the above-mentioned devices.

In the variable capacity compressor operation mode determination method according to the embodiments of the present disclosure, the ratio relationship between the current value before the operation mode of the compressor is switched and the current value after the operation mode is switched is compared, accordingly whether the switching of the operation mode of the compressor is successful can be accurately determined; the single-cylinder operation mode, the double-cylinder operation mode or the multi-cylinder operation mode with more than three cylinders can be effectively controlled to achieve the purpose of optimizing the use of the compressor.

BRIEF DESCRIPTION OF THE DRAWINGS

FIG. 1 is a flow chart of a variable capacity compressor operation mode determination method according to an embodiment of the present disclosure.

DETAILED DESCRIPTION

The technical solutions in the embodiments are described clearly and completely below. Apparently, the described embodiments are merely some embodiments of the present disclosure, rather than all the embodiments. Based on the embodiments of the present disclosure, all other embodiments obtained by those of ordinary skill in the art without creative work shall fall within the protection scope of the present disclosure.

A compressor including one cylinder is a single-cylinder compressor, a compressor including two cylinders is a two-cylinder compressor, and a compressor including more than three cylinders is a multi-cylinder compressor. The volume of the cylinders in the compressor can be the same or different. Each cylinder in the compressor can work independently.

The compressor in the present disclosure includes at least two cylinders, and at least one cylinder is in a working state.

It should be noted that the condition that the cylinder is in working condition means that the inner rotor performs a gas compression work process. A condition that cylinder is in a non-working state means that the inner rotor thereof does not compress gas to do work.

The compressor in the present disclosure includes a two-cylinder compressor or a multi-cylinder compressor with more than three cylinders. The operation mode of the compressor includes a single-cylinder operation mode, a two-cylinder operation mode, or an operation mode of more than three cylinders.

The compressor is in the single-cylinder operation mode, which means that only one cylinder is in the working state.

The compressor is in the two-cylinder operation mode, which means that two cylinders are in the working state.

The compressor is in the operating mode of more than three cylinders, which means that more than three cylinders are in the working state.

When the compressor operation mode is switched, the compressor current may change significantly due to the sudden change in compressor work.

When the compressor is switched to the operation mode in which the number of the cylinders in the working state is increased, the effective current of the compressor may suddenly increase; when the compressor is switched to the operation mode in which the number of the cylinders in the working state is reduced, the effective current of the compressor may suddenly decrease.

For example, if the compressor is switched from the single-cylinder operation mode to double-cylinder operation mode, the effective current of the compressor may suddenly increase; if the compressor is switched from the double-cylinder operation mode to the single-cylinder operation mode, the effective current of the compressor may suddenly decrease.

In some embodiments, a variable capacity compressor operation mode determination method is provided, in which a current value of a compressor at present is A1 before switching an operation mode of the compressor.

After the operation mode of the compressor is switched and the preset time is reached, the current value of the compressor at present is detected to be A2.

Comparing A1 with A2, when a ratio relationship between A1 and A2 satisfies a preset condition, it is determined that the switching of the operation mode of the compressor is successful; when the ratio relationship between A1 and A2 dissatisfies the preset condition, it is determined that the switching of the operation mode of the compressor fails.

In the present disclosure, whether the switching of the operation mode of the compressor is successful is determined according to the ratio relationship of the current changes before and after the switching of the operation mode of the compressor; and accordingly the determination result is more stable and more accurate.

In some embodiments, a variable capacity compressor operation mode determination method is provided, in which a difference value P0 between a discharge pressure P1 and a suction pressure P2 of a compressor is controlled in a first preset range before switching an operation mode of the compressor. In some embodiments, P0=P1−P2.

Then the current value of the compressor at present is detected, and the current value of the compressor at present is A1.

The operation mode of the compressor is switched, and after the preset time is reached, the current value of the compressor at present is detected to be A2.

A1 is compared to A2, when the ratio relationship between A1 and A2 satisfies the preset condition, it is determined that the switching of the operation mode of the compressor is successful; when the ratio relationship between A1 and A2 dissatisfies the preset condition, it is determined that the switching of the operation mode of the compressor is failed.

Before the current value A1 when the operation mode of the compressor is not switched is compared to the current value A2 after the operation mode is switched, the difference value P0 between the discharge pressure P1 and the suction pressure P2 of the compressor is controlled within a preset range, which can accurately determine whether the switching of the operation mode of the compressor is successful. Effective control is performed for the single-cylinder operation mode, the double-cylinder operation mode or the multi-cylinder operation mode with more than three cylinders, to achieve the purpose of optimizing the use of the compressor.

In some embodiments, before the operation mode of the compressor is switched, the difference value P0 between the discharge pressure P1 and the suction pressure P2 of the compressor is controlled within a first preset range, with satisfying P0=P1−P2. In addition, the operation frequency K of the compressor is controlled within a second preset range.

Then the current value of the compressor at present is detected, the current value of the compressor at present is A1.

After the operation mode of the compressor is switched and the preset time is reached, the current value of the compressor at present is detected to be A2.

A1 is compared to A2, when the ratio relationship between A1 and A2 satisfies the preset condition, it is determined that the switching of the operation mode of the compressor is successful; when the ratio relationship between A1 and A2 dissatisfies the preset condition, it is determined that the switching of the operation mode of the compressor is failed.

In some embodiments, before the operation mode of the compressor is switched, the operation frequency of the compressor is first controlled within the second preset range, and then the current value of the compressor at present is detected.

In some embodiments, before the current value A1 when the compressor operation mode is not switched is compared to the current value A2 after the operation mode is switched, the difference value P0 between the discharge pressure P1 and the suction pressure P2 of the compressor is controlled within the preset range and the operation frequency of the compressor is controlled within the preset range, which can accurately determine whether the switching of the operation mode of the compressor is successful. The effectively control is performed on the single-cylinder operation mode, the double-cylinder operation mode or the multi-cylinder operation mode with more than three cylinders, to achieve the purpose of optimizing the use of the compressor.

In the present disclosure, before the current is compared or the operation mode of the compressor is switched, it is necessary to control the compressor to satisfy the condition in which the difference value P0 between the discharge pressure P1 and the suction pressure P2 is controlled within the first preset range, or to control the compressor to satisfy the conditions in which the difference value P0 between the discharge pressure P1 and the suction pressure P2 is controlled within the first preset range and the operation frequency of the compressor is within the second preset range, because:

1) Due to the increase of the opening of the throttle valve, the startup of the internal machine or the switching on of a bypass pipeline (i.e., a pipeline connecting the high-pressure end and the low-pressure end of the compressor, the pipeline is provided with an on-off valve) between the suction and exhaust, unloading of the pressure difference between the suction and exhaust makes the difference value P0 between the discharge pressure P1 and the suction pressure P2 of the compressor rapidly decrease, and accordingly the current value of the compressor is also rapidly decreased (assuming that the operation frequency of the compressor remains unchanged), which may result in erroneously determining that the switching of the operation mode of the compressor is successful. Therefore, in the present disclosure, before the current is compared, the difference value P0 between the discharge pressure P1 and the suction pressure P2 of the compressor is controlled within the first preset range to improve the accuracy of determination of whether the switching of the operation mode of the compressor is successful.
2) If the compressor is actually switched from the single-cylinder operation mode to the double-cylinder operation mode (the current is increased), but at the same time the bypass pipeline between suction and discharge is switched on, the difference value P0 between the discharge pressure P1 and the suction pressure P2 of the compressor is decreased (the decrease of the pressure difference results in the decrease of the current), and the compressor current may not change or change very little, then the switching of the operation mode of the compressor is misjudged as a failure. Therefore, in the present disclosure, before the current is compared, the difference value P0 between the discharge pressure P1 and the suction pressure P2 of the compressor is controlled within the first preset range, to improve the accuracy of determination of whether the switching of the operation mode of the compressor is successful.
3) When the compressor is in the single-cylinder operation mode, the operation frequency of the compressor suddenly rises from 5 Hz to 10 Hz, then the current value increases, which may easily result in erroneously determining that the operation mode of compressor is switched successfully into an operation mode in which the number of cylinders in the working state is increased. Similarly, the operation frequency of the compressor is reduced from 10 Hz to 5 Hz. Therefore, in the present disclosure, before the current is compared, the operation frequency of the compressor is controlled within the second preset range, to improve the accuracy of determination of whether the switching of the operation mode of the compressor is successful.
4) When the internal machine starts up or the bypass pipeline between the suction and exhaust is switched on, and the operation frequency of the compressor is reduced, the current decreases faster and it is easier to misjudge that the double-cylinder operation mode is switched to the single-cylinder operation mode. Therefore, in the present disclosure, before the current is compared or the operation mode of the compressor is switched, it is necessary to control the compressor to satisfy two conditions, that is, the difference value P0 between the discharge pressure P1 and the suction pressure P2 of the compressor is within the first preset range, and the operation frequency of the compressor is within the second preset range, to improve the accuracy of determination of whether the switching of the operation mode of the compressor is successful.

In the present disclosure, the switching is performed when the difference value P0 between the discharge pressure P1 and the suction pressure P2 of the compressor and the operation frequency are both stable, to eliminate the influence of the frequency and the difference between suction pressure and discharge pressure on the change in the compressor current and ensure accurate determination of whether the switching of the operation mode of the compressor is successful.

In some embodiments, the first preset range is [a, b], if P0<a, the pressure difference is increased by increasing the operation frequency of the compressor; if P0>b, the difference value P0 between the discharge pressure P1 and the suction pressure P2 of the compressor is decreased through pressure relief performed by decreasing the operation frequency of the compressor, and/or, by starting up a compressor suction-discharge side bypass mechanism. Where, a represents a set lower limit value of the first preset range; b represents a set upper limit value of the first preset range.

In some embodiments, the first preset range is 20 Hz to 30 Hz.

In some embodiments, before the current value A1 of the compressor at present is detected, the operation frequency K of the compressor is controlled within the second preset range.

In some embodiments, the second preset range is [x, y]. If K<x, the operation frequency of the compressor is increased; and if K>y, the operation frequency of the compressor is decreased. Where, x represents the set lower limit value of the second preset range; y represents the set upper limit value of the second preset range.

In some embodiments, the second preset range is 1 MPa to 2 MPa.

In some embodiments, the switching of the operation mode of the compressor includes a first switching mode and a second switching mode. The first switching mode: the compressor is switched to an operation mode in which the number of cylinders in the working state is increased. The second switching mode: the compressor is switched to an operation mode in which the number of cylinders in the working state is reduced.

In some embodiments, A1 is compared to A2, and when the compressor is switched to the operation mode in which the number of cylinders in the working state is increased, the relationship between A1 and A2 satisfies the preset condition A2≥m*A1, where m≥1, then it is determined that the switching of the operation mode of the compressor is successful.

In some embodiments, A1 is compared to A2, and when the compressor is switched to the operation mode in which the number of cylinders in the working state is reduced, the relationship between A1 and A2 satisfies the preset condition A2≤A1/m, where m then it is determined that the switching of the operation mode of the compressor is successful.

In some embodiments, a value range of m is [1.2, 2].

In some specific embodiments, the compressor is a double-cylinder compressor, and includes: a compressor suction pressure detection device, a compressor discharge pressure detection device, a first cylinder, a second cylinder, a single and double cylinder switching mechanism, a compressor current detection device, a compressor suction-discharge side bypass mechanism. The volume of the first cylinder is different from that of the second cylinder.

The operation mode of the double-cylinder compressor includes a single-cylinder operation mode and a double-cylinder operation mode.

When the compressor needs to switch from the single-cylinder operation mode to the double-cylinder operation mode:

the difference value P0 between the discharge pressure P1 and the suction pressure P2 of the compressor is controlled within a range of [a1, b1]. If P0<a1, the difference value P0 is increased by increasing the operation frequency of the compressor. If P0>b1, the difference value P0 is decreased through pressure relief performed by decreasing the operation frequency of the compressor and starting up the suction-discharge side bypass mechanism.

The operation frequency K of the compressor is controlled with a range of [x1, y1]. If K<x1, the operation frequency of the compressor is increased; and if K>y1, the operation frequency of the compressor is decreased.

a1, b1, x1, and y1 are preset values, and specific values can be obtained through experiments.

After the system reaches the above conditions (satisfying the above two conditions at the same time), the effective value A1 of the compressor current is detected, and then the single-cylinder operation mode is switched to the double-cylinder operation mode, and the effective value A2 of the compressor current is detected after t seconds.

A1 is compared to A2, if A2 it is determined that the switching of the operation mode of the compressor is successful, where m≥1. m is mainly related to the ratio of the displacement of the compressor in the single-cylinder operation mode to the displacement of the compressor in the double-cylinder operation. The greater the ratio, the greater the value of m. In some embodiments, the value of m is obtained according to the difference between the suction pressure and discharge pressure of the compressor, and the volume ratio of the large cylinder to the small cylinder of the compressor. If A2<m*A1, it is considered that the switching of the operation mode fails.

In the present disclosure, whether the switching of the operation mode of the compressor is successful is determined according to the multiple m of the current change before and after switching of the operation mode of the compressor, accordingly the determination result is more stable and more accurate. For example, when the two cylinders are not same, the current change caused by switching the operation mode under a state of a low frequency and a low pressure difference is small, but it still makes the multiple of the current change before and after switching the operation mode greater than a certain preset value. In a similar way, the current change caused by switching the operation mode under a state of a high frequency and a high pressure difference can also make the multiple of the current change before and after switching the operation mode greater than a certain preset value.

In the present disclosure, a method for determining whether the switching of the operation mode of the compressor is successful according to the multiple m of the current change before and after switching the operation mode of the compressor covers conditions of various frequencies and various pressure differences. In addition, the proportionality value m has a linear relationship with the proportionality value n. The proportionality value n is a ratio of the displacement of the unloadable cylinder to the displacement of the entire compressor.

When the compressor needs to switch from the double-cylinder operation mode to the single-cylinder operation mode:

the difference value P0 between the discharge pressure P1 and the suction pressure P2 is controlled in a range of [a2, b2]; if P0<a2, the difference value P0 is increased by increasing the operation frequency of the compressor and the like; if P0>b2, the difference value P0 is reduced by reducing the operation frequency of the compressor and by relieving the pressure through switching on the suction-discharge side bypass mechanism. Similarly, before the switching, the difference value P0 between the discharge pressure P1 and the suction pressure P2 of the compressor is controlled within the range of [a2, b2].

The operation frequency K of the compressor is controlled in the range of [x2, y2], if K<x2, the operation frequency of the compressor is increased; and if K>y2, the operation frequency of the compressor is reduced.

a2, b2, x2, y2 are preset values, and specific values thereof can be obtained through experiments.

After the system reaches the above conditions (i.e., the above two conditions are met at the same time), the conditions need to be met simultaneously to ensure no misjudgment. The effective value A1 of the compressor current is detected, and then the double-cylinder operation mode is switched to the single-cylinder operation mode, and the effective value A2 of the compressor current is detected after t seconds.

A1 is compared to A2, if A2≤A1/m, it is determined that the switching of the operation mode is successful, where m≥1. m is mainly related to the ratio of the displacement of the compressor in the single-cylinder operation mode to the displacement of the compressor in the double-cylinder operation. The larger the ratio, the larger the value of m. In some embodiments, the value of m is obtained according to the difference between the suction pressure and discharge pressure of the compressor, and the volume ratio of the large cylinder to the small cylinder of the compressor. If A≤A21/m, it is considered that the switching of the operation mode fails.

FIG. 1 is a flow chart that illustrates a non-limiting example embodiment of a variable capacity compressor operation mode determination method according to various aspects of the present disclosure. Block 102 illustrates controlling a difference value P0 between a discharge pressure P1 and a suction pressure P2 of the compressor within a first preset range. Block 104 illustrates detecting a current value of a compressor at present as A1 before switching an operation mode of the compressor. Block 106 illustrates detecting the current value of the compressor at present as A2 after switching the operation mode of the compressor and reaching a preset time. Block 108 illustrates comparing A1 and A2, determining that the switching of the operation mode of the compressor is successful when a ratio relationship between A1 and A2 satisfies a preset condition, and determining that switching of the operation mode of the compressor is failed when the ratio relationship between A1 and A2 dissatisfies the preset condition.

In some embodiments, a device is provided, which can perform the method in any of the above embodiments. The device includes a variable capacity compressor operation mode determination device, a computer device or a storage device including computer executable instructions.

The device provided by some embodiments includes a variable capacity compressor operation mode determination device. The variable capacity compressor operation mode determination device includes a detection unit which is configured to detect a current value of a compressor at present as A1 before switching an operation mode of the compressor, and is configured to detect the current value of the compressor at present as A2 after switching the operation mode of the compressor and reaching the preset time.

In some embodiments, the variable capacity compressor operation mode determination device includes a comparison determination unit which is configured to compare A1 with A2, and determine that the switching of the operation mode of the compressor is successful when the ratio relationship between A1 and A2 satisfies a preset condition, and determine that the switching of the operation mode of the compressor is failed when the ratio relationship between A1 and A2 dissatisfies the preset condition.

In some embodiments, the variable capacity compressor operation mode determination device includes a regulation unit which is configured to, before switching the operation mode of the compressor, control the difference value P0 between the discharge pressure P1 and the suction pressure P2 of the compressor within the first preset range and then detect the current value of the compressor at present as A1.

In some embodiments, the variable capacity compressor operation mode determination device includes a regulation unit which is configured to, before switching the operation mode of the compressor, control the operation frequency of the compressor within a second preset range and then detect the current value of the compressor at present as A1.

In some embodiments, the device includes a computer device. The computer device includes a memory, a processor, and a computer program stored on the memory and executable on the processor; the processor executes the computer program to implement the variable capacity compressor operation mode determination method in any of the above embodiments.

In some embodiments, the device includes a storage device including computer-executable instructions. The storage device including the computer-executable instructions is configured to, when executed by a computer processor, execute the variable capacity compressor operation mode determination method in any of the above embodiments.

In some embodiments, a variable capacity compressor is provided, which includes any of the above-mentioned devices, that is, includes a variable capacity compressor operation mode determination device, or a computer device, or a storage device including computer executable instructions.

In some embodiments, an air conditioner is provided, which includes any of the above-mentioned devices, that is, includes a variable capacity compressor operation mode determination device, or a computer device, or a storage device including computer executable instructions.

The above-mentioned compressor may be a variable-frequency variable-capacity compressor, a double-rotor compressor, a three-rotor compressor, or a rotor compressor with more than three rotors. In some embodiments, the cylinders in the variable-frequency variable-capacity compressor are equal-volume cylinders or large and small cylinders.

In the description of the present disclosure, it should be understood that the terms "first", "second", "third" and other terms used to define parts are only for the convenience of distinguishing the above-mentioned parts, and unless otherwise stated, the above words have no special meaning, and therefore cannot be understood as limiting the scope of protection of the present disclosure.

Finally, it should be noted that the above embodiments are only used for illustrating the technical solution of the present disclosure rather than limiting it; although the present disclosure has been described in detail with reference to preferred embodiments, those of ordinary skill in the art should understand that: the disclosed specific implementations can be modified or some technical features can be equivalently replaced without departing from the spirit of the technical solution of the present disclosure, and these should all fall within the scope of protection of the technical solution.

What is claimed is:

1. A variable capacity compressor operation mode determination method, comprising:

controlling a difference value P0 between a discharge pressure P1 and a suction pressure P2 of a compressor within a first preset range before switching an operation mode of the compressor;

detecting a current value of the compressor at present as A1 before the switching of the operation mode of the compressor;

switching the operation mode of the compressor, and after a preset time period, detecting the current value of the compressor at present as A2; and comparing A1 and A2, and determining that the switching of the operation mode of the compressor is successful when a ratio relationship between A1 and A2 satisfies a preset condition, and determining that the switching of the operation mode of the compressor is failed when the ratio relationship between A1 and A2 dissatisfies the preset condition.

2. The variable capacity compressor operation mode determination method according to claim 1, further comprising: if the difference value P0 between the discharge pressure P1 and the suction pressure P2 of the compressor is less than a set lowest value of the first preset range, increasing the difference value P0 between the discharge pressure P1 and the suction pressure P2 by increasing an operation frequency of the compressor.

3. The variable capacity compressor operation mode determination method according to claim 1, further comprising: if the difference value P0 between the discharge pressure P1 and the suction pressure P2 of the compressor is greater than a set highest value of the first preset range, reducing the difference value P0 between the discharge pressure P1 and the suction pressure P2 of the compressor by at least one of reducing the operation frequency of the compressor or by pressure relief which is performed by switching on a compressor suction-discharge side bypass mechanism.

4. The variable capacity compressor operation mode determination method according to claim 1, further comprising: controlling an operation frequency of the compressor within a second preset range and then detecting the current value of the compressor at present before switching the operation mode of the compressor.

5. The variable capacity compressor operation mode determination method according to claim 4, further comprising: increasing the operation frequency of the compressor if the operation frequency of the compressor is less than a set lowest value of the second preset range, and reducing the operation frequency of the compressor if the operation frequency of the compressor is greater than a set highest value of the second preset range.

6. The variable capacity compressor operation mode determination method according to claim 1, wherein the compressor comprises at least two cylinders; the switching of the operation mode of the compressor comprises a first switching mode and a second switching mode; in the first switching mode, the compressor is switched to an operation mode in which a number of the cylinders in the working state is increased; in the second switching mode, the compressor is switched to an operation mode in which a number of the cylinders in the working state is reduced.

7. A variable capacity compressor operation mode determination device, configured to implement the variable capacity compressor operation mode determination method of claim 1, comprising:

a regulation unit, configured to control a difference value P0 between a discharge pressure P1 and a suction pressure P2 of a compressor within a first preset range before a detection unit starting to execute;

the detection unit, configured to detect a current value of the compressor at present as A1 before switching an operation mode of the compressor, switch the operation mode of the compressor, and after a preset time period, detect the current value of the compressor at present as A2; and a comparison determination unit, configured to compare A1 with A2, and determine that the switching of the operation mode of the compressor is successful when the ratio relationship between A1 and A2 satisfies a preset condition, and determine that the switching of the operation mode of the compressor is failed when the ratio relationship between A1 and A2 dissatisfies a preset condition.

8. A computer device, comprising a memory and a processor, wherein a computer program is stored on the memory and executable on the processor, and the processor executes the computer program to implement the variable capacity compressor operation mode determination method of claim 1.

9. A storage device comprising computer-executable instructions, the storage device comprising the computer-executable instructions is configured to, when executed by a computer processor, perform the variable capacity compressor operation mode determination method of claim 1.

10. A variable capacity compressor, comprising the device of claim 7.

11. An air conditioner, comprising the device of claim 7.

12. A variable capacity compressor operation mode determination method, comprising:

controlling a difference value P0 between a discharge pressure P1 and a suction pressure P2 of a compressor within a first preset range before switching an operation mode of the compressor;

detecting a current value of the compressor at present as A1 before the switching of the operation mode of the compressor;

switching the operation mode of the compressor, and after a preset time period, detecting the current value of the compressor at present as A2; and comparing A1 with A2, and determining that the switching of the operation mode of the compressor is successful when the compressor is switched to an operation mode in which a number of cylinders in a working state is increased and a relationship between A1 and A2 satisfies a preset condition $A2 \geq m*A1$, wherein $m \geq 1$, and determining that the switching of the operation mode of the compressor is failed when the ratio relationship between A1 and A2 dissatisfies the preset condition.

13. The variable capacity compressor operation mode determination method according to claim 12, wherein a value range of m is [1.2, 2].

14. A variable capacity compressor operation mode determination method, comprising:

controlling a difference value P0 between a discharge pressure P1 and a suction pressure P2 of a compressor within a first preset range before switching an operation mode of the compressor;

detecting a current value of the compressor at present as A1 before the switching of the operation mode of the compressor;

switching the operation mode of the compressor, and after a preset time period, detecting the current value of the compressor at present as A2; and comprising: comparing A1 with A2, and determining that the switching of the operation mode of the compressor is successful when the compressor is switched to an operation mode in which a number of cylinders in a working state is reduced and the ratio relationship between A1 and A2 satisfies a preset condition $A2 \leq A1/m$, wherein $m \geq 1$, and determining that the switching of the operation mode of the compressor is failed when the ratio relationship between A1 and A2 dissatisfies the preset condition.

15. The variable capacity compressor operation mode determination method according to claim 14, wherein a value range of m is [1.2, 2].

* * * * *